US005240898A

United States Patent [19]

Yoshida et al.

[11] Patent Number: 5,240,898

[45] Date of Patent: Aug. 31, 1993

[54] HEAT SENSITIVE RECORDING MATERIAL

[75] Inventors: Hiroyuki Yoshida; Masahiko Yamaguchi; Toshiyuki Abe; Masami Ito, all of Yokohama, Japan

[73] Assignee: Hodogaya Chemical Co., Ltd., Tokyo, Japan

[21] Appl. No.: 939,709

[22] Filed: Sep. 2, 1992

[30] Foreign Application Priority Data

Sep. 4, 1991 [JP] Japan ..... 3-250265

[51] Int. Cl.[5] ..... B41M 5/30

[52] U.S. Cl. ..... 503/209; 503/214; 503/216; 503/217; 503/218

[58] Field of Search ..... 503/208, 209, 216, 210-212, 503/214, 217, 218

[56] References Cited

PUBLICATIONS

Patent Abstracts of Japan, vol. 10, No. 176, (M-491)(2232), Jun. 20, 1986, & JP-A-61 027 285, Feb. 6, 1986, Shigetoshi Hiraishi, et al., "Thermal Recording Material".

*Primary Examiner*—Pamela R. Schwartz

*Attorney, Agent, or Firm*—Oblon, Spivak, McClelland, Maier & Neustadt

[57] ABSTRACT

A heat sensitive recording material comprising a support and a recording layer formed on the support, the recording layer comprising, as essential components, a colorless or light-colored electron donative dyestuff, an acidic substance to let the electron donative dyestuff form a color when heated, and a binder, wherein 2-[(phenylthio)methyl]naphthalene is incorporated in the recording layer.

6 Claims, No Drawings

HEAT SENSITIVE RECORDING MATERIAL

The present invention relates to a heat sensitive recording material. More particularly, it relates to a heat sensitive recording material having a high sensitivity and excellent light resistance and moisture resistance and having the heat sensitive properties improved. Particularly, it relates to a heat sensitive recording sheet having a color forming sensitivity and heat resistance improved.

A recording layer for a heat sensitive recording sheet is required to have excellent heat sensitive properties including self-color development resistance, minimum pressure sensitivity, light resistance, heat decolorization resistance, humidity decolorization resistance and water resistance. However, there has been no recording layer which fully satisfies all of these requirements. On the other hand, reflecting the social demand for high speed transmission of information, it is desired to develop a heat sensitive recording material having a high sensitivity suitable therefor i.e. being capable of forming a color at a high density with a low energy, along with the improvement of the recording apparatus itself for high speed.

To improve the color forming sensitivity, it has been proposed to incorporate a certain compound to a heat sensitive recording layer, as disclosed, for example, in Japanese Unexamined Patent Publications No. 116690/1982, No. 64592/1982, No. 112788/1983, No. 30557/1984, No. 165682/1984, No. 56588/1985, No. 82382/1985, No. 272189/1986, No. 126784/1988 and No. 40373/1989.

The present inventors have prepared heat sensitive recording sheets in accordance with conventional methods and with the methods disclosed in the above patent publications using known electron donative colorless dyestuffs as color formers and have tested the properties required for heat sensitive recording sheets, whereby compounds excellent in the color forming sensitivity and stability of the formed images, have been found to present substantial background fogging when tested for the background fogging and image shelf stability and thus found to be inadequate for the purpose of improving the sensitivity of the heat sensitive recording material.

The present inventors have conducted extensive researches with an aim to overcome the above drawbacks with respect to a heat sensitive recording material wherein a known electron donative colorless dyestuff is used and as a result, have accomplished the present invention. It is therefore an object of the present invention to provide a heat sensitive recording sheet having the color forming sensitivity and heat resistance improved without staining the background when tested for the image shelf stability.

The present invention provides a heat sensitive recording material comprising a support and a recording layer formed on the support, the recording layer comprising, as essential components, a colorless or light-colored electron donative dyestuff, an acidic substance for the electron donative dyestuff form a color when heated, and a binder, wherein 2-[(phenylthio)methyl]-naphthalene is incorporated in the recording layer.

The naphthalene compound to be used in the present invention, may be employed in combination with the above-mentioned known compounds i.e. compounds as disclosed in e.g. Japanese Unexamined Patent Publications No. 116690/1982, No. 64592/1982, No. 112788/1983, No. 30557/1984, No. 165682/1984, No. 56588/1985, No. 82382/1985, No. 272189/1986, No. 126784/1988 and No. 40373/1989.

The compound to be used in the present invention may have a substituent such as an alkyl group, an alkoxy group, a nitro group or a halogen atom on its naphthalene nuclei and the benzene nuclei. Such a compound can be prepared by a conventional method. It is usually obtained by using 2-chloromethylnaphthalene and thiophenol as starting materials and reacting them in a polar solvent by means of a base.

The colorless electron donative dyestuff (color former) to be used in the present invention includes, for example, triarylmethane compounds, diphenylmethane compounds, xanthene compounds, fluorene compounds, pentadiene compounds, thiazine compounds, oxazine compounds and spiropyran compounds.

More specifically, the triarylmethane compounds include, for example, 3,3-bis(p-dimethylaminophenyl)-6-dimethylaminophthalide(CVL), 3, 3-bis(p-dimethylainophenylphthalide), 3-(p-dimethylaminophenyl)-3-(1,3-dimethylindol-3-yl)phthalide, 3-(p-dimethylaminophenyl-3-(2-methylindole-3-yl)phthalide, 3,3-bis(2-(methoxyphenyl)-2-(4-dimethylaminophenyl-)ethenyl))-4,5,6,7-tetrachlorophthalide, and 3,3-bis((1,1-bis(4-pyrrolidilonophenyl)ethylen-2-yl))-4,5,6,7-tetrachlorophthalide.

The xanthene compounds include, for example, rhodamine B-anilinolactam, rhodamine B(p-nitroanilino)-lactam, rhodamine B(o-chloroanilino)lactam, 2-dibenzylamino-6-diethylaminofluoran, 2-anilino-6-diethylaminofluoran, 2-anilino-3-methyl-6-diethylaminofluoran, 2-anilino-3-methyl-6-(n-cyclohexyl-n-methyl-)aminofluoran, 2-o-chloroanilino-6-diethylaminofluoran, 2-o-chloroanilino-6-dibutylaminofluoran, 2-p-chloroanilino-6-diethylaminofluoran, 2-octylamino-6-diethylaminofluoran, 2-p-acetylanilino-6-diethylaminofluoran, 2-ethoxyethylamino-3-chloro-6-diethylaminofluoran, 2-anilino-3-chloro-6-diethylaminofluoran, 2-diphenylamino-6-diethylaminofluoran, 2-anilino-6-(N-ethyl-N-tolyl)aminofluoran, 2-anilino-3-methyl-6-(N-ethyl-N-tolyl)aminofluoran, 2-anilino-3-methyl-6-(N-methyl-N-n-propyl)aminofluoran, 2-anilino-3-methoxy-6-dibutylaminofluoran, 2-anilino-3-methyl-6-N,N-dibutylaminofluoran, 2-anilino-3-methyl-6-(N-ethyl-N-tetrahydrofurfuryl)aminofluoran, 2-anilino-3-methyl-6-(N-n-butyl-N-tetrahydrofurfuryl)aminofluoran, 2-anilino-3-methyl-6-(N-ethyl-N-isoamyl)aminofluoran, 2-anilino-3-methyl-6-(N-ethyl-N-isobutyl)aminofluoran, 2-chloro-3-methyl-6-p (p-phenylaminophenyl-)aminoanilinofluoran, 2-p-phenylureidoanilino-6-N-methylaminofluoran, and 2,2-bis[4-(6'-(N-cyclohexyl-N-methylamino)-3'-methylspiro[isobenzofuran-3,9'-xanthen]-2'-ylamino)phenyl]propane.

Fluorene compounds include, for example, 3',6'-bis-diethylamino-5-diethylamino spiro(isobenzofuran-1,9'-fluoren)-3-one, and 3',6'-bisdiethylamino-5-dibutylamino spiro(isobenzofuran-1,9'-fluoren)-3-one.

The pentadiene compounds include, for example, 1-(α-methoxy(4-N,N-dimethylamino)benzyl)-3-(4-N,N-dimethylaminobenzylidene)-5-methyl-cyclohexene.

The thiazine compounds include, for example, benzoylleuco-methylene blue, and p-nitrobenzyl-leuco-methylene blue.

The oxazine compounds include, for example, 3,7-bis(diethylamino)-10-benzoylphenoxazine, and 3,7-bis(-diethylamino)-10-acetylphenoxazine. The spiropyran compounds include, for example, 3-methylspirodinaphthopyran, 3-benzylspiro-dinaphthopyran, and 3-propylspiro-dibenzopyran.

These colorless electron donative dyestuffs may be used alone or in combination as a mixture. Further, in the present invention, the colorless electron donative dyestuff is not limited to the above exemplified colorless electron donative dyestuffs.

The electron accepting compound (color developing agent) to be used in the present invention is preferably a phenol compound, an organic acid or its metal salt, or a hydroxybenzoic acid ester. Specifically, it includes, for example, salicylic acid, 3-isopropylsalicylic acid, 3,5-di-tert-butylsalicylic acid, 3,5-di-α-methylbenzylsalicylic acid, 2',4-dihydroxydiphenyl ether, 1,5-bis(3-hydroxyphenoxy)pentane, 4,4'-isopropylidenediphenol, 4,4'-isopropylidenebis(2-chlorophenol), 4,4'-isopropylidenebis(2,6'-dichlorophenol), 4,4'-isopropylidenebis(2,6-dimethylphenol), 4,4'-isopropylidenebis(2-tert-butylphenol), 4,4'-cyclohexylidenebisphenol, 4,4'-cyclohexylidenebis(2-methylphenyl), 4-tert-butylphenol, 4-phenylphenol, 4-hydroxydiphenoxide, α-naphthol, β-naphthol, 3,5-xylenol, thimol, methyl-bis(4-hydroxyphenyl)acetate, n-butyl-bis(4-hydroxyphenyl)acetate, 4,4'-thiodiphenol, bis(4-hydroxy-3-methylphenyl)sulfide, 4,4'-diphenolsulfone, 4-isopropoxy-4'-hydroxydiphenylsulfone, 1,7-di(4-hydroxyphenylthio)-3,5'dioxaheptane, chloroglycincarboxylic acid, 4-tert-octylcatechol, 2,2-methylenebis(4-chlorophenol), 2,2'-methylenebis(4-methyl-6-tert-butylphenol), 2,2'-dihydroxydiphenyl, ethyl p-hydroxybenzoate, propyl p-hydroxybenzoate, butyl p-hydroxybenzoate, benzyl p-hydroxybenzoate, p-chlorobenzyl p-hydroxybenzoate, o-chlorobenzyl p-hydroxybenzoate, p-methylbenzyl p-hydroxybenzoate, n-octyl p-hydroxybenzoate, benzoic acid, zinc salicylate, 1-hydroxy-2-naphthoic acid, 2-hydroxy-6-naphthoic acid, zinc 2-hydroxy-6-naphthoate, 4-hydroxydiphenylsulfone, 4-hydroxy-4'-chlorodiphenylsulfone, 2-hydroxy-p-toluic acid, zinc 3,5-tert-butylsalicylate, tin 3,5-tert-butylsalicylate, tertatic acid, oxalic acid, maleic acid, citric acid, succinic acid, stearic acid, 4-hydroxyphthalic acid, boric acid, a thiourea derivative and a 4-hydroxythiophenol derivative.

A water-soluble or non-water soluble binder is used as the binder to bond the mixture of the color forming agent and the color developing agent onto the support sheet. Typical binders include, for example, polyvinyl alcohol, methyl cellulose, hydroxy ethyl cellulose, carboxy methyl cellulose, gum arabic, starch, gelatin, casein, polyvinyl pyrrolidone, a styrene-maleic anhydride copolymer, polyacrylic acid amide, a polyacrylate, a terpene resin and a petroleum resin. The binder which is particularly suitable for use in the present invention, is a water-soluble binder, and a typical example of such a water-soluble binder is polyvinyl alcohol.

Now, a specific process for preparing a heat sensitive recording sheet using the heat sensitive recording material of the present invention, will be described. In the preparation of a heat sensitive recording sheet, the weight ratios of the above-mentioned respective components and the binder in the recording layer are such that relative to the color former, the color developing agent is from 0.5 to 5.0 times, preferable from 1.0 to 3 times, 2-[(phenylthio)methyl]naphthalene is from 0.5 to 10.0 times, preferably from 1.0 to 4.0 times, and the binder is from 0.3 to 3.0 times, preferably from 0.5 to 2.0 times.

The color former and the color developing agent are preferably separately dispersed by means of a dispersing machine such as a ball mill, a dyno mill, a sand mill or a paint conditioner, and 2-[(phenylthio)methyl]naphthalene may be dispersed alone or together with the color former or the color developing agent. They are respectively dispersed in water or an organic medium containing the binder, preferably in water having the binder dissolved therein, and pulverized to obtain suspensions having a particle size of from 1 to 6 μm, preferably from 1 to 3 μm. If necessary, a defoaming agent, a dispersant or a bleaching agent may be added prior to the dispersion and pulverization.

Then, separately dispersed and pulverized suspensions of the respective components, are mixed so that the weight ratios of the respective components would be within the above-mentioned proportions, to obtain a coating material useful for forming a heat sensitive recording layer. This coating material is coated on the surface of paper by means of a wire bar No. 6 to No. 20 so that the weight of the solid after drying would be from 3 to 10 g/m$^2$, followed by drying in an air-circulated drier at a temperature of from room temperature to 70° C. to obtain a heat sensitive recording sheet of the present invention. If necessary, an inorganic or organic filler may be added to the coating material in order to improve the writability and the anti-fusion property to a thermal head.

The heat sensitive recording sheet thus obtained is excellent particularly in the color forming sensitivity among the heat sensitive properties, and it is free from the whitening phenomenon which impairs the commercial value of the heat sensitive recording sheet and excellent in the heat resistance and the background fog heat resistance, whereby the drawbacks of the conventional heat sensitive recording sheets have been effectively overcome.

Now, the present invention will be described in further detail with reference to Examples and Comparative Examples. However, it should be understood that the present invention is by no means restricted by such specific Examples. In the following Examples and Comparative Examples, "parts" means "parts by weight".

EXAMPLE 1

The following dispersions A, B, C and D were prepared, respectively:

| Dispersion A (Dispersion of a dyestuff) | |
|---|---|
| 2-anilino-3-methyl-6-dibutylaminofluoran | 8 parts |
| Stearic acid amide | 4 parts |
| 10% polyvinyl alcohol aqueous solution | 40 parts |
| Water | 28 parts |
| **Dispersion B (Dispersion of a color developing agent)** | |
| Bisphenol A | 5 parts |
| Zinc stearate | 3 parts |
| 2-[(phenylthio)methyl]naphthalene | 6 parts |
| 4,4'-butylidenebis-(3-methyl-6-tert-butyl)phenol | 1.5 parts |
| 10% polyvinyl alcohol aqueous solution | 10 parts |
| Water | 54.5 parts |

Dispersion C (Dispersion of a filler)

A 30% calcium carbonate dispersion

Solution D (Solution of a binder)

A 10% polyvinyl alcohol aqueous solution

The dispersions A, B and C having the above compositions were respectively pulverized by a dyno mill KDL dispersing machine to a particle size of from 1.5 to 3 μm.

Then, the dispersions were mixed in the following proportions to obtain a heat sensitive coating material.

| | |
|---|---|
| Dispersion A | 4 parts |
| Dispersion B | 16 parts |
| Dispersion C | 10 parts |
| Solution D | 8 parts |

This mixed coating material was applied onto the surface of a sheet of high quality paper by means of a wire bar coater No. 18 in such an amount that the weight of the solid content after drying would be 7 g/m$^2$ and then dried in an air-circulating drier to obtain a heat sensitive recording sheet.

COMPARATIVE EXAMPLE 1

Dispersion E was prepared in the same manner as the preparation of dispersion B except that 2-[(phenylthio)-methyl]naphthalene in dispersion B in Example 1 was changed to 4-benzylbiphenyl.

| | |
|---|---|
| Dispersion A | 4 parts |
| Dispersion E | 16 parts |
| Dispersion C | 10 parts |
| Solution D | 8 parts |

Using the above coating material, a heat sensitive recording sheet was prepared int he same manner as in Example 1.

COMPARATIVE EXAMPLE 2

Dispersion F was prepared in the same manner as in the preparation of dispersion B except that 2-[(phenylthio)methyl]naphthalene in dispersion B in Example 1 was changed to 2-benzyloxynaphthalene.

| | |
|---|---|
| Dispersion A | 4 parts |
| Dispersion F | 16 parts |
| Dispersion C | 10 parts |

-continued

| | |
|---|---|
| Solution D | 8 parts |

Using the above coating material, a heat sensitive recording sheet was prepared in the same manner as in Example 1.

The heat sensitive recording sheets obtained in Example 1 and Comparative Examples 1 and 2 were, respectively, cut into prescribed sheets with a width of 20 cm and subjected to calendar treatment by a mini calendar made by Uriroll to a degree of smoothness of 30 seconds, followed by the performance test. The results are shown in Table 1.

TABLE 1

| | Compound | Color-forming sensitivity (Note 1) | D0 (Note 2) | Heat resistance (Note 3) | D3 (Note 4) |
|---|---|---|---|---|---|
| Example 1 | 2-[(phenylthio)methyl]naphthalene | 23.3 | 0.06 | 91.5 | 0.08 |
| Comparative Example 1 | 4-benzyldiphenyl | 30.9 | 0.09 | 35.0 | 0.21 |
| Comparative Example 2 | 2-benzyloxynaphthalene | 32.0 | 0.09 | 40.1 | 0.16 |

Note 1: The heat sensitive recording sheets was color-developed by a dynamic color forming tester manufactured by Matsushita Denshi Buhin K.K. in accordance with a developed color density-color forming energy curve wherein the ordinate represents the color density and the abscissa represents the color forming energy. The color-developed portion was measured by a Macbeth reflective density meter RT-918, whereby the color-developing energy showing the reflective density of 1.0 was rated to be J 1.0, and the energy (mj/mm$^2$) at that time was designated as the color-forming sensitivity.

Note 2: Under the above condition (Note 1), the non-developed portion was represented by background D0.

Note 3: This represents the heat resistant image shelf stability after the image-forming. Namely, the developed color density D2 after 24 hours at 60° C. of the portion of J 1.0 developed under the above condition (Note 1) was measured, and the developed color remaining rate was calculated in accordance with the following formula: The developed color remaining rate = (D2/1.0) × 100 The heat resistance was represented by this value.

Note 4: The developed color density after 24 hours at 60° C. of the above-mentioned non-developed portion (Note 3), was measured, and this was designated as heat resistance background D3.

Note 1: The heat sensitive recording sheet was color-developed by a dynamic color forming tester manufactured by Matsushita Denshi Buhin K.K. in accordance with a developed color density-color forming energy curve wherein the ordinate represents the color density and the abscissa represents the color forming energy. The color-developed portion was measured by a Macbeth reflective density meter RT-918, whereby the color-developing energy showing the reflective density of 1.0 was rated to be J 1.0, and the energy (mj/mm$^2$) at that time was designated as the color-forming sensitivity. Note 2: Under the above condition (Note 1), the non-developed portion was represented by background D0. Note 3: This represents the heat resistant image shelf stability after the image-forming. Namely, the developed color density D2 after 24 hours at 60° C. of the portion of J 1.0 developed under the above condition (Note 1) was measured, and the developed color remaining rate was calculated in accordance with the following formula:

The developed color remaining rate $=(D2/1.0)\times 100$

The heat resistance was represented by this value. Note 4: The developed color density after 24 hours at 60° C. of the above-mentioned non-developed portion (Note 3), was measured, and this was designated as heat resistance background D3.

The heat sensitive recording material of the present invention wherein the naphthalene compound is incorporated in the heat sensitive recording layer, has a white background and has an excellent color-forming sensitivity and heat resistant image shelf stability. Further, the background fog heat resistance is excellent. Thus, it provides excellent properties as a heat sensitive recording material.

We claim:

1. A heat sensitive recording material comprising a support and a recording layer formed on the support, the recording layer comprising, as essential components, a colorless or light-colored electron donative dyestuff, an acidic substance for the electron donative dyestuff to form a color when heated, and a binder, wherein 2-[(phenylthio)methyl]naphthalene is incorporated in the recording layer.

2. The heat sensitive recording material according to claim 1, wherein the recording layer comprises one part by weight of the colorless or light-colored electron donative dyestuff, from 0.5 to 5.0 parts by weight of the acidic substance, from 0.5 to 10.0 parts by weight of the 2-[(phenylthio)methyl]naphthalene and from 0.3 to 3.0 parts by weight of the binder.

3. The heat sensitive recording material according to claim 1, wherein the electron donative dyestuff is selected from the group consisting of triarylmethane compounds, diphenylmethane compounds, xanthene compounds, fluorene compounds, pentadiene compounds, thiazine compounds, oxazine compounds and spiropyran compounds.

4. The heat sensitive recording material according to claim 1, wherein the acidic substance is a phenolic compound, an organic acid or its metal salt, or a hydroxybenzoic acid ester.

5. The heat sensitive recording material according to claim 1, wherein the binder is a water-soluble binder.

6. The heat sensitive recording material according to claim 1, wherein the binder is polyvinyl alcohol.

* * * * *